United States Patent [19]

Childs

[11] 4,146,443

[45] Mar. 27, 1979

[54] INTRODUCING FEED INTO EXTERNALLY CIRCULATING ELECTROLYTE IN ELECTROCHEMICAL PROCESS

[75] Inventor: William V. Childs, Bartlesville, Okla.

[73] Assignee: Phillips Petroleum Company, Bartlesville, Okla.

[21] Appl. No.: 832,771

[22] Filed: Sep. 13, 1977

[51] Int. Cl.[2] ..... C25B 3/08; C25B 15/08

[52] U.S. Cl. ..... 204/62; 204/239

[58] Field of Search ..... 204/239, 59 R, 62, 268, 204/274

[56] References Cited

U.S. PATENT DOCUMENTS

| | | | |
|---|---|---|---|
| 3,558,450 | 1/1971 | Ashe, Jr. et al. | 204/59 R |
| 3,788,965 | 1/1974 | Holsinger | 204/234 |
| 3,819,503 | 6/1974 | Casson et al. | 204/268 |
| 3,876,516 | 4/1975 | Pace et al. | 204/239 X |
| 3,882,001 | 5/1975 | Mills | 204/59 R |
| 4,052,287 | 10/1977 | Westerlund | 204/239 |

*Primary Examiner*—John H. Mack
*Assistant Examiner*—D. R. Valentine

[57] ABSTRACT

In an electrochemical operation, e.g., fluorination of an organic compound, the electrolyte is removed from the electrochemical cell, optionally circulated through a cooler, and returned to the cell. The feed is introduced into the electrolyte externally of the cell. The electrolyte, containing the feed, is introduced into the bottom portion of the cell which can be a multiple electrodes-containing cell in view of the feed introduction. Optimum design, disregarding substantially entirely heat buildup, is made possible. Fluorination of an organic compound is described.

5 Claims, 3 Drawing Figures

INTRODUCING FEED INTO EXTERNALLY CIRCULATING ELECTROLYTE IN ELECTROCHEMICAL PROCESS

This invention relates to electrochemical cell construction and operation. In one of its aspects, the invention relates to the manner of introducing feed into the electrolyte during the operation of an electrochemical cell, e.g., a cell in which electrofluorination is being effected.

In one of its concepts, the invention provides an electrochemical cell structure having a means for circulating electrolyte from the cell during the operation of the cell and means by which said electrolyte can be recycled to the cell means for introducing feed to said electrolyte while it is outside said cell, and means for introducing said electrolyte, together with entrained feed material or by-products which may be contained in the electrolyte to said cell. In another of its concepts, the invention provides a multiple electrode electrochemical cell employing external circulation of electrolyte as herein described. In a further concept of the invention, the structure provides for introduction of a circulating electrolyte containing feed added to it into a lower portion or bottom of the cell structure.

BACKGROUND OF THE INVENTION

Electrochemical fluorination is a process whereby the passage of an electrolytic current is made to incorporate fluorine into a substrate by addition or substitution. This process can be used to produce perfluorocarbons, a class of compounds or substances known for their outstanding chemical, electrical, and thermal stability. It can also be used to produce materials which are reactive and useful as chemical intermediates; these products include hexafluoroacetone, perfluoroacyl fluorides, and perfluoroesters. Other products include sulfur hexafluoride and carbonyl fluoride.

The passage of this electrolytic current (electrolysis) is effected through an electrolyte which usually is liquid hydrogen fluoride or hydrogen fluoride complexed with a current-conducting additive such as an alkali metal fluoride. This current is passed between a cathode and a porous anode contained in an electrolysis cell; hydrogen gas is evolved at the cathode; and fluorine is generated at the anode. The fluorine reacts with the material to be fluorinated while it is within the pores of the anode.

It is known that production rate is contained in large part by the density of the current within the electrolyte solution, which for a normal one-cell unit, such as shown in U.S. Pat. No. 3,882,001, is about 2.5 to 3.0 K amp/m$^2$. The disclosure of the patent is incorporated by this reference. Increasing the current density with a corresponding increase in feed rate increases production rates, but it also increases temperature within the cell frequently beyond the capabilities of the heat-removing apparatus of the cell. Mass transfer is an important part of heat transfer, and, in the usual electrochemical fluorination apparatus, this mass transfer is carried out by thermal siphon and by hydrogen lift.

Although fairly efficient, the process is hazardous because of the toxic and corrosive nature of hydrogen fluoride. This makes maintenance difficult during cell repair. With certain cell configurations, feed lines become plugged with salts when the feed is passed from the bottom of the cell through the electrolyte into the anode area. When the feed is passed through the top of the cell down into the anode area, plugging at least at the anode is avoided.

An object of this invention is to provide an electrochemical object. Another operation of this invention is to provide an electrochemical cell structure. Still another object of this invention is to provide a feed introduction means permitting improved design and multiple electrodes containing cell structure. A further object of this invention is to provide such a multiple electrode electrochemical cell structure. A further object of this invention is to provide an optimum designed electrochemical cell structure which can be designed disregarding problems due to evolution of heat. A further object of the invention is to provide a structure for an electrochemical cell such that plugging of the cell is entirely avoided.

Other aspects, concepts, objects, and the several advantages of the invention are apparent from a study of this disclosure, the drawing, and the appended claims.

According to the present invention, there is provided a process for conducting an electrochemical reaction in an electrochemical reaction zone or cell which comprises circulating at least a portion of the electrolyte in said zone from said zone, adding feed to cooling said electrolyte, and then returning at least a portion of the electrolyte containing said feed to said reaction zone.

Still according to the invention, there is provided an electrochemical cell having multiple electrodes therein and means associated with said cell for cooling the electrolyte externally of said cell.

Further according to the invention, there is provided a process for conducting an electrochemical reaction in an electrochemical reaction zone or cell having multiple electrodes therein which comprises circulating at least a portion of the electrolyte in said zone from said zone to a cooling zone, in said cooling zone cooling said electrolyte, and then returning at least a portion of the thus-cooled electrolyte to said reaction zone.

Still further according to the invention feed added to the circulating electrolyte is returned to the area at the bottom of the anodes in the cell for passage upwardly through the anodes.

In an embodiment according to the invention there is provided, see FIG. 1, a feed disengaging area at the bottom of the anode to ensure that feed will disengage from the electrolyte and pass upwardly through the anode area while the electrolyte, upon disengagement of the feed, is passed through the space or area between an anode and a cathode.

In a specific embodiment of the invention, there is provided an electrochemical fluorination operation of a cell structure according to an embodiment of the invention.

Advantages of the process of the invention are as follow:

1. The feed is introduced through the bottom of the multi-cell unit. Thus the top of the assembly is less cluttered as are other configurations, making maintenance operations simpler and safer. This can be and in the now preferred embodiment is done by introducing the feed with the cooled, recycled electrolyte as described below. These advantages are made possible by the introduction of the feed into the electrolyte.

2. The electrolyte is circulated and cooled externally to the cell using a pump and external heat exchanger. Such pumping permits faster flow of the electrolyte than can be obtained with the usual thermal siphon and hydrogen gas lift. This higher flow will permit operation at a higher current density at the same voltage, or at the same current density with a lower voltage. Thus, one can obtain higher productivity or lower electrical energy consumption. The invention permits a simpler, more compact cell design since no provision need be made for internal heat exchange surface or down-comer tubes. It also permits simple filtering of the electrolyte to remove the sludge that accumulates in cell operation.

3. It is simpler to accurately split a large volume stream of electrolyte containing dispersed feed into several streams, for feeding individual streams for such feeding. The small orifices ordinarily needed to split just the feed stream when not added to the electrolyte as is done in the present invention, are prone to plug and corrode as the recycle feed frequently contains considerable HF and, on occasion, some heavy material.

The single cell data used herein to illustrate the invention are based on the process described by R. B. MacMullin et al., J. Electrochem. Soc., Vol. 118, No. 10, 1582 (1971), and U.S. Pat. No. 3,711,396. Porous electrodes of a particular kind for use in electrochemical processes are described and claimed in U.S. Pat. No. 3,558,450. These disclosures are incorporated herein by reference.

FEEDSTOCK MATERIALS

Feedstock materials to which this invention can be applied include any type of materials suitable for electrochemical fluorination, such as hydrocarbons (paraffinic or aromatic, saturated or unsaturated), oxygenated compounds (ketones, esters, acids, alcohols, ethers, carbon monoxide, carbon dioxide), halogenated compounds (chloroform, chloroethane, dichloroethane), or any other material known to be capable of electrochemical fluorination.

ELECTROLYTE

The electrochemical fluorination process is carried out in a medium of hydrogen fluoride electrolyte. Although the hydrogen fluoride electrolyte can contain small amounts of water, such as up to about five weight percent, it usually is preferred that the electrolyte be essentially anhydrous. The hydrogen fluoride electrolyte is consumed in the reaction and must be either continuously or intermittently replaced to maintain constant composition and operating bath levels.

Pure anhydrous liquid hydrogen fluoride is nonconductive. The essentially anhydrous liquid hydrogen fluoride described herein has a low conductivity which, generally speaking, is low than desired for practical operation. To provide adequate conductivity in the electrolyte, and to reduce the hydrogen fluoride vapor pressure at cell operating conditions, an inorganic additive can be and usually is incorporated in the electrolyte. Examples of suitable additives are inorganic compounds which are soluble in liquid hydrogen fluoride and provide effective electrolytic conductivity. The now usually preferred additives are the alkali metal (sodium, potassium, lithium, rubidium, and cesium) fluorides and ammonium fluoride. Other additives which can be employed are sulfuric and phosphoric acid. Potassium fluoride, cesium fluoride, and rubidium fluoride are the preferred additives. Potassium fluoride is a particularly preferred additive. The additives can be utilized in any suitable molar ratio of additive to hydrogen fluoride within the range of from 1:4.5 to 1:1, preferably 1:4 to 1:2. The presently preferred electrolytes include those which correspond approximately to the formulas KF.2HF, KF.3HF, or KF.4HF. Such electrolytes can be conveniently prepared by adding the required quantity of hydrogen fluoride to KF.HF (potassium bifluoride). In general, said additives are not consumed in the process and can be used indefinitely. A small amount of lithium fluoride is also sometimes added. Said additives are frequently referred to as conductivity additives for convenience. It is in the use of such electrolytes as here described that the invention is especially applicable.

The cell body, cathode, anode, and the configuration of the electrochemical cell unit are known in the art. Suffice here to note that the gap or space designed into such units is such that cooling of the electrolyte internally of the unit is not practical.

Figure 1:
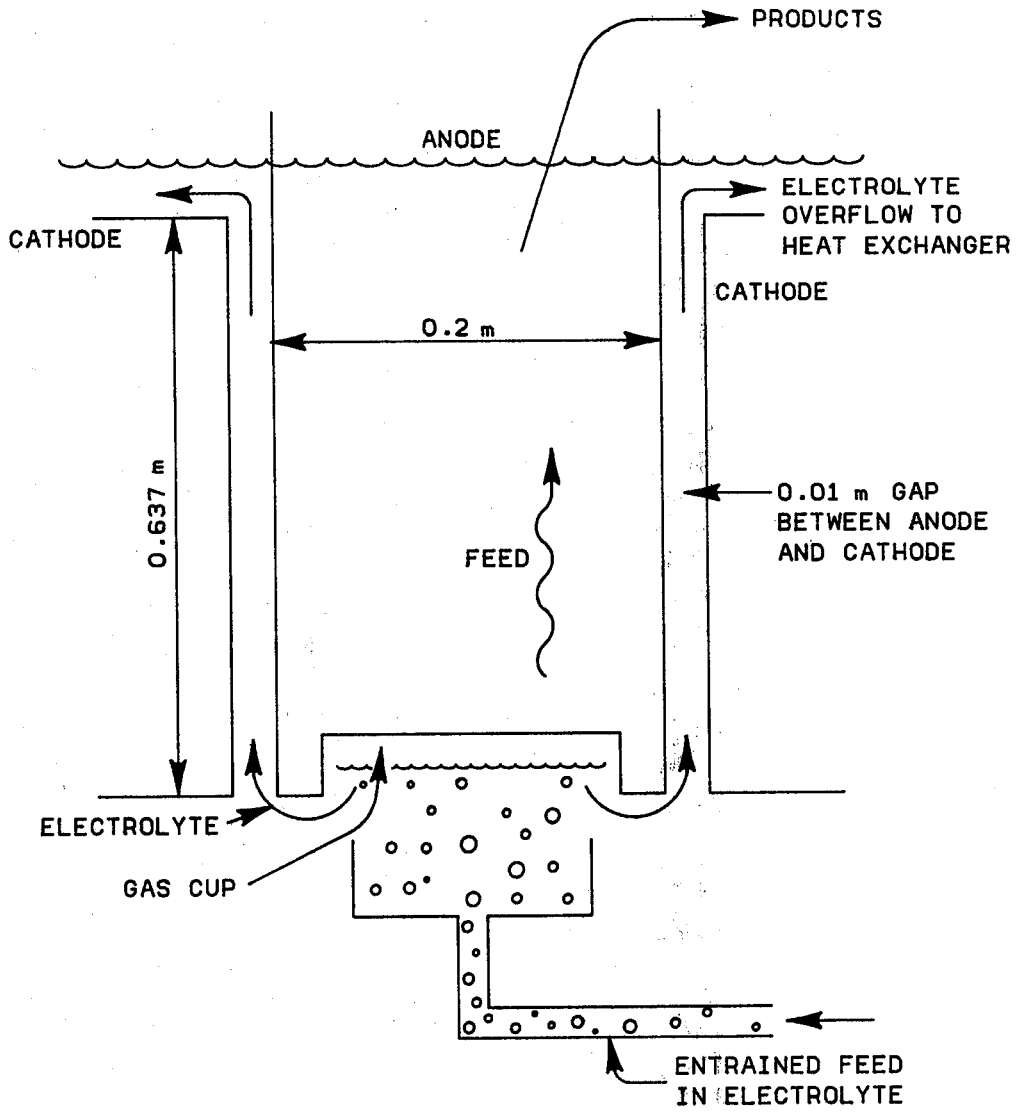
FIG. 1 is a diagrammatic view of an individual electrode unit.

The electrode configuration as shown in FIG. 1 is not intended to limit the size of the electrodes but merely to serve as an illustration of one type arrangement. The broad range for the gap distance between the anode surface and the cathode surface is $0.254 \times 10^{-3}$m (0.01 inch) to 0.254m (10 inches) with a usually preferred range of $0.51 \times 10^{-3}$m (0.02 inch) to 0.0254m (1.0 inch).

EXTERNAL COOLING AND CIRCULATING UNIT

Figure 2:
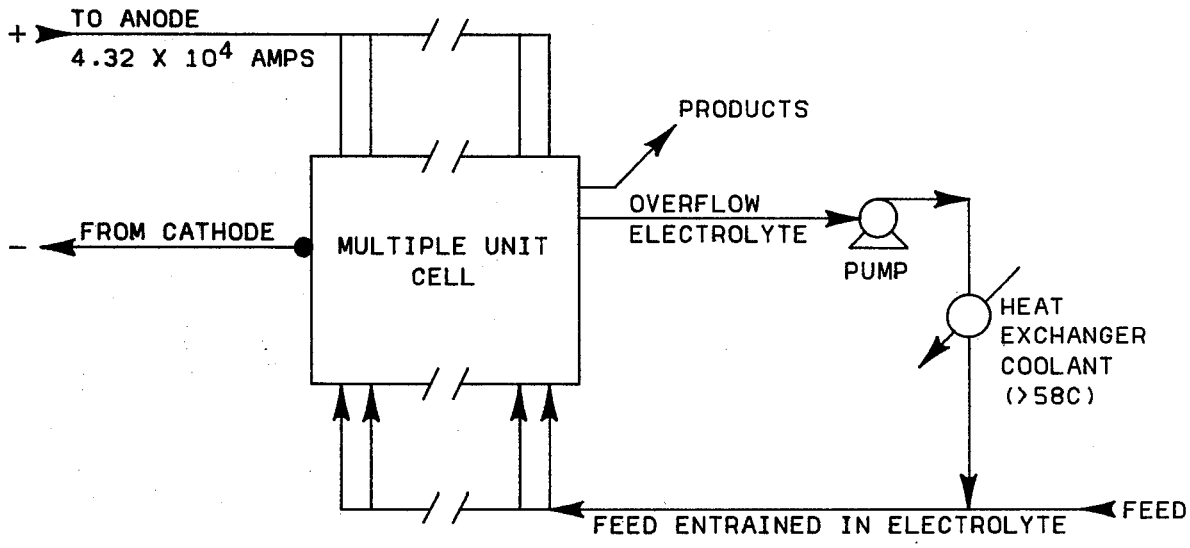
FIG. 2 is a flow diagram showing an operation according to the invention.

FIG. 2 shows the circulation route an external cooling of an electrolyte solution described herein and the addition of the feed to the electrolyte while it is outside the cell or reaction zone. Any type pump capable of circulating electrolyte can be used for this invention.

The invention permits circulating, as rapidly as desired and as possible a large amount or volume of electrolyte to which the feed is added, without regard to cell size or structure. Likewise, any type heat exchanger capable of cooling said electrolyte can be used for this invention. The pump, heat exchanger, and all lines to and from these units should be constructed of materials that will resist any corrosive nature of the electrolyte. When the electrolyte is composed of potassium fluoride or hydrogen fluoride, the temperature of the coolant in the heat exchanger should be maintained above about 60° C. so as to prevent crystallization which as noted earlier occurs at about 58° C. The coolant can be any convenient liquid suitable as a heat exchange medium, such as water, methanol, glycol, and the like.

PROCESS OPERATING CONDITIONS

Temperature

When fluorinating an organic, it is now preferred to operate at temperatures such that the vapor pressure of the electrolyte will be less than about 50 mm Hg. As will be understood by those skilled in the art, the vapor pressure of the electrolyte at a given temperature will be dependent upon its composition. It is well known that additives such as potassium fluoride cause the vapor pressure of liquid hydrogen fluoride to be decreased an unusually great amount. A presently preferred range of temperature is from about 60° C. to about 110° C.

Pressure

Pressures substantially above or below atmospheric can be employed if desired, depending upon the vapor pressure of the electrolyte as discussed above. Broadly a range of 0.5 to 3.0 atmospheres can be employed with a preferred range of about 0.9 to 1.5 atmospheres. In all instances, the cell pressure should be sufficient to maintain a liquid phase of electrolyte and also such as to provide for easy removal of the products.

Current Density

For purposes of efficiency and economy, the rate of direct current flow through each electrode is maintained at a rate which will give the highest practical current densities for the electrodes employed. Generally speaking, the current density should be high enough so that anodes of moderate size can be used, yet low enough so that said anodes are not corroded or disintegrated under the given current flow. Current densities within the range of from 0.3 to 10.0 or more, preferably 1.0 to 4.0 kiloamps per square meter of each anode geometric surface area can be used. Current densities less than about 0.3 $KA/m^2$ of anode geometric surface are not practical because the rate of fluorination is too slow. The voltage which is employed will vary depending upon the particular cell configuration employed and the current density employed. Voltages in the range of from 4 to 12 volts per electrode are typical. The maximum voltages during depolarization will reach about 80 volts. Thus, as a guide in practicing this invention, voltages in the range of 4 to 12 volts per electrode can be used for normal operations. The present invention permits the designer to design the best or optimum cell without regard to heat evolved to the extent that the external cooling provided will cope with such heat.

Feed Rate

Feed rates which can be employed in the practice of this invention depend in part upon several things among which are the type of carbon used in the porous anode, the number of electrodes employed in the complete cell, and the nature of the material being fluorinated. Because of the wide nature of materials that can be employed in this invention, feed rates are thought of in terms of how much hydrogen is replaced with fluorine in a molecule of feed. Therefore, a broad feed rate range to each individual anode can be 5 to 125 percent per pass replacement of hydrogen equivalent with a preferred range of 20–90 percent per pass replacement of hydrogen equivalent. Using ethane as in the example, this would be interpreted as a broad range of 33 to 835 liters per hour and a narrow range of 55 to 334 liters per hour.

In the preferred method of practicing this invention, the feed rate will be such that the feedstock is passed into the pores of the anode, and into contact with the fluorinating species therein, at a flow rate such that the inlet pressure of said feedstock into said pores is essentially less than the sum of (a) the hydrostatic pressure of the electrolyte at the level of entry of the feedstock into said pores and (b) the exit pressure of any unreacted feedstock and fluorinated products from said pores into the electrolyte. Said exit pressure is defined as the pressure required to form a bubble on the outer surface of the anode and break said bubble away from said surface.

Again, the virtual elimination of the heat problem will permit the designer to better concentrate with greater flexibility upon the optimum feed rate, etc.

EXAMPLE I — PRIOR ART

This is a calculated example of a single electrode containing electrofluorination cell based on experience with fluorination cells having similar structure.

A porous carbon anode is fabricated from National Carbon 45, having an average pore size of about 55 microns, a permeability of about 20 darcys, and a total porosity of about 50% and is a cylinder measuring 0.673m (26.5 inches) × 0.2m (7.8 inches). A cavity, 0.152m (6.0 inch diameter) × 0.019m (0.75 inch deep) is cut into the bottom of the anode. Positioned around the anode is a circular iron cathode measuring 0.637m (25.1 inches) × 0.22m (8.66 inches) ID with 0.006m (0.25 inch) thick walls. The distance between the outer anode surface and inner cathode surface (gap distance) is 0.01m (0.39 inches).

The above-described electrode is placed in an electrochemical conversion cell which contains KF.2HF as the electrolyte maintained at about 100°–105° C. An ethane feed tube of 0.0047m (0.187 inch) copper tubing encased in a 0.006m (0.25 inch) Teflon tubing is provided. This tubing extends to the bottom of the electrode and feeds ethane directly into the electrode cavity. The anode is submerged 0.658m (25.9 inches) into the electrolyte and, during operation, the fluorinated products and unconverted feed material leave the electrode through the portion of the porous carbon above the surface of the electrolyte. Hydrogen is evolved at the cathode.

The following operating conditions would normally be expected to prevail in a single operation as described in this example.

| | |
|---|---|
| Electrolyte circulation (through Anode-Cathode 0.01m Gap) | $5.0 \times 10^3$ liters/hr |
| Ethane feed rate at 25% per pass replacement of hydrogen | 167 liters/hr (7.47 moles/hr) |
| Current | 1.2 kiloamps |
| Voltage | ~9 volts |
| Heat evolved | 10.8 kilowatts |
| Temperature | 105° C |

Product distribution is as follows:

| | Mole Percent |
|---|---|
| $CH_3 — CH_3$ | 23.3 |
| $CFH_2 — CH_3$ | 7.5 |
| $CFH_2 — CFH_2$ | 5.8 |
| $CF_2H — CH_3$ | 3.9 |
| $CF_2H — CFH_2$ | 12.9 |
| $CF_3 — CH_3$ | 2.4 |
| $CF_2H — CF_2H$ | 10.5 |
| $CF_3 — CFH_2$ | 7.0 |
| $CF_3CF_2H$ | 9.4 |
| $CF_3 — CF_3$ | 13.9 |
| $CF_4$ | 0.6 |
| $C_3$ + flourides | 2.8 |
| Ethane Conversion, % | 77.1 |
| Current efficiency, % | 100.0 |

CALCULATED ILLUSTRATION — EXAMPLE II

Figure 3:
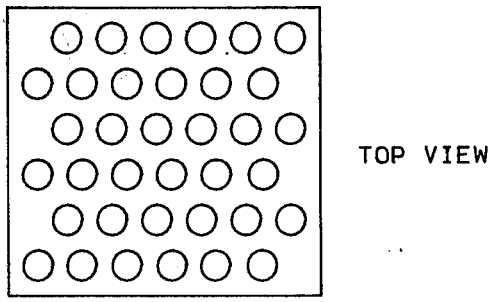
FIG. 3 is a multiple electrode cell set forth for use according to the invention.

This is a calculated example of a 36 electrode containing electrofluorination cell. The electrodes are the same size as described in example I and are arranged in the cell unit as shown in FIG. 3, although any convenient or practical arrangement can be used with any number of electrodes as desired. In this example, electrodes are submerged the same depth as for the single electrode cell. The pipes from the electrochemical cell to the external heat exchanger and back to the cell must accommodate circulating electrolyte and any entrained organic or in this example ethane on the return to the cell. The electrochemical fluorination process at each anode-cathode surface is the same for the 36-electrode unit as for the single electrode unit, that is, reactant is converted to a fluorination product in the anode area. The product, unreacted reagent, and hydrogen by-product is removed through the top of the electrochemical fluorination cell. As noted, FIG. 2 shows, according to the invention, the general operation, in which the electrolyte is passed from the cell unit through a circulating pump, into a heat exchanger, back to the fluorination cell, and finally through the gap area between the anode and cathode. Ethane is fed into the circulating electrolyte liquid between the heat exchanger and the fluorination cell. The ethane is insoluble in the electrolyte and thus readily separates in the cap area at the bottom of the anodes for passage through the anodes, the electrolyte not passing through the anodes but rather going through the area between each anode and cathode.

The above-described multi-electrode cell, fluorination, and circulation process is calculated to be carried out under the following operating conditions.

| | |
|---|---|
| Electrolyte circulation (through Anode-Cathode 0.01m gap) | $5. \times 10^3$ liters/hr |
| Electrolyte circulation (through heat exchanger) | $1.8 \times 10^5$ liters/hr |
| Ethane feed rate at 25% per pass replacement of hydrogen | $6. \times 10^3$ liters/hr (268 moles/hr) |
| Current | 43 kiloamps |
| Voltage | ~9 volts |
| Heat evolved | 390 kilowatts |
| Temperature | 105° C |

Product distribution is the same as shown in example I except the rate at which product is produced is multiplied by the number of electrodes used in the cell; which is made possible by the invention.

During the process hydrogen fluoride is consumed. As HF is consumed, KF.HF forms as a by-product that tends to precipitate during operations but is partially solubilized by the KF.xHF (x = 2, 3, or 4) plus its sweeping action through the feed lines prevents any plugging to occur in the feed lines. Hydrogen fluoride is periodically added to the electrolyte solution to convert the by-product KF.HF back to the electrolyte KF.xHF.

Care should be taken during the operation to maintain the temperature above about 60° C. The electrolyte, KF.2HF has a freezing point about 58° C. that could cause plugging if allowed to cool below about 60° C. For this reason the electrolyte circulating lines are insulated to assist in maintaining the electrolyte temperature above about 60° C.

Usually, when fluorinating, as with an electrolyte as herein described, the temperature thereof will vary in the approximate range of from about 110° C. in the cell to about 60° C. after it is cooled and prior to its return to the cell. Obviously the temperature in the cell and that to which the electrolyte is cooled prior to its recycle to the cell will depend upon the nature of the electrochemical reaction being conducted and upon the electrolyte used.

Reasonable variation and modification are possible within the scope of the foregoing disclosure, the drawing and the appended claims to the invention the essence of which is that by providing external introduction of the feed into the electrolyte and circulation thereof to said cell admixed with said electrolyte plugging is avoided and the electrolyte is fed back to the cell, optionally after cooling, to a bottom portion thereof, with a facilitated, much improved distribution of feed to each anode in a multiple cell or reaction zone.

I claim:

1. A process for conducting an electrochemical fluorination reaction upon an organic compound in an electrochemical fluorination reaction zone or cell containing a plurality of anodes which comprises circulating at least a portion of the electrolyte in said zone from said zone, adding to the electrolyte which has been removed from said zone, the organic compound feed for said electrochemical fluorination reaction, subdividing the mixture of feed and electrolyte thus obtained, and then returning a portion of said electrolyte now containing said feed to each of the anodes in said reaction zone.

2. A process according to claim 1 wherein the electrolyte and feed mixture returned to said reaction zone is introduced into the bottom portion of said reaction zone.

3. A process according to claim 1 wherein the feed is an organic compound immiscible with said electrolyte and the disengaged feed is passed through the anode.

4. A process according to claim 1 wherein the temperature of the electrolyte in the electrochemical fluorination reaction zone is of the order of not more than about 110° C. and cooling is effected to reduce that temperature to about 60° C. before recycling the cooled electrolyte and its contained feed to the reaction zone wherein an electrofluorination process is being conducted and the electrolyte is prepared by adding hydrogen fluoride to KF.HF.

5. A process according to claim 1 wherein the electrolyte and the feed admixed therewith is subdivided and is fed into a reaction zone to just below each of a plurality of anodes in said reaction zone, whereby deposits in said zone at the entry of said zone of the electrolyte of solid decomposition product stemming from the electrolyte are avoided.

* * * * *